US010099393B2

(12) United States Patent
Gester et al.

(10) Patent No.: US 10,099,393 B2
(45) Date of Patent: Oct. 16, 2018

(54) HEATED SHAVING RAZOR

(71) Applicant: The Gillette Company, Boston, MA (US)

(72) Inventors: Matthias Gester, Farnborough (GB); Robert Anthony Hart, Bracknell (GB)

(73) Assignee: The Procter & Gamble Company, Cincinnati, OH (US)

( * ) Notice: Subject to any disclaimer, the term of this patent is extended or adjusted under 35 U.S.C. 154(b) by 300 days.

(21) Appl. No.: 14/546,079

(22) Filed: Nov. 18, 2014

(65) Prior Publication Data

US 2015/0068043 A1 Mar. 12, 2015

Related U.S. Application Data

(63) Continuation of application No. 12/186,715, filed on Aug. 6, 2008, now abandoned.

(51) Int. Cl.
*B26B 21/48* (2006.01)

(52) U.S. Cl.
CPC ..... *B26B 21/48* (2013.01)

(58) Field of Classification Search
CPC ..... B26B 21/48
See application file for complete search history.

(56) References Cited

U.S. PATENT DOCUMENTS 2,063,808 A 12/1936 Henderson et al.
2,536,844 A 1/1951 Carlton et al.
3,325,627 A 6/1967 Adler
3,876,858 A * 4/1975 Davis ..... B26F 3/06 156/513
4,253,013 A 2/1981 Mabuchi
5,065,515 A * 11/1991 Iderosa ..... A61B 18/203 132/200
5,653,025 A * 8/1997 Cheng ..... B26B 21/48 30/140
6,817,101 B1 11/2004 Bohmer
6,836,966 B2 1/2005 Patrick
6,868,610 B2 3/2005 Brandt et al.
6,946,624 B1 9/2005 Tomassetti
(Continued)

FOREIGN PATENT DOCUMENTS

EP 1 363 517 B1 2/2008
FR 2 716 402 8/1995
(Continued)

*Primary Examiner* — Kenneth E. Peterson
*Assistant Examiner* — Liang Dong
(74) *Attorney, Agent, or Firm* — John M. Lipchitz

(57) ABSTRACT

A razor having a handle with a power source. A cartridge has a skin contacting surface mounted to the handle. A metallic heat dissipating strip has an upper skin contact surface adjacent to the skin contacting surface of the cartridge. A heating element is positioned below the heat dissipating strip. The heating element has a resistive member with a pair of electrical contacts and a resistance of about 0.5 Ohms to about 20 Ohms. A ceramic insulating member is positioned between the metal heat dissipating strip and the resistive member. An electrical circuit is in electrical communication with the power source and is configured to deliver energy to the resistive member to heat the resistive member of the heating element. The resistive member of the heating element delivers heat to the heat dissipating strip.

18 Claims, 11 Drawing Sheets

(56) References Cited

U.S. PATENT DOCUMENTS

| | | | | |
|---|---|---|---|---|
| 2003/0046816 | A1 | 3/2003 | Kanzer | |
| 2003/0226258 | A1* | 12/2003 | Patrick | B26B 19/382 30/34.05 |
| 2005/0189338 | A1 | 9/2005 | Sukeforth | |
| 2006/0070242 | A1* | 4/2006 | Szczepanowski | B26B 21/48 30/140 |
| 2006/0117568 | A1 | 6/2006 | Tomassetti | |
| 2006/0123631 | A1 | 6/2006 | Szczepanowski et al. | |
| 2007/0084058 | A1 | 4/2007 | Szczepanowski et al. | |
| 2010/0024615 | A1 | 2/2010 | Rebaudieres et al. | |

FOREIGN PATENT DOCUMENTS

| | | | | |
|---|---|---|---|---|
| FR | 2716402 | A1 * | 8/1995 | B26B 19/382 |
| JP | 09082547 | A * | 3/1997 | |
| WO | WO 02/072495 | A2 | 9/2002 | |

* cited by examiner

HEATED SHAVING RAZOR

TECHNICAL FIELD

This invention relates to shaving razors and razor cartridges, and more particularly to heated razors for wet shaving.

BACKGROUND

Users of wet-shave razors generally appreciate a feeling of warmth against their skin during shaving. The warmth feels good, resulting in a more comfortable shave.

Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery.

Razor blades within a razor cartridge have also been heated. The drawback with heated blades is they have minimal surface area in contact with the user's skin. This minimal skin contact area provides a relatively inefficient mechanism for heating the user's skin during shaving.

There is a need to provide a razor capable of delivering improved heating capability to the user during shaving.

SUMMARY

The invention features a razor comprising a handle and a cartridge mounted on the handle. The cartridge comprises a guard, a cap, and one or more blades located between the guard and the cap. The guard is positioned in front of the one or more blades. The cap is positioned behind the one or more blades. The cartridge, guard and cap each have a skin contacting surface and an opposed bottom surface.

A heat dissipating strip is positioned within the cartridge. The heat dissipating strip may be placed in the guard, the cap or both. The heat dissipating strip comprises a skin contacting surface and a second surface opposed to the skin contacting surface.

The razor comprises a heating element positioned below the second surface of the heat dissipating strip. Preferably the heating element is positioned above the bottom surface of the guard or cap of the cartridge. The heating element comprises a resistive member having a first surface and an opposed second surface and an insulating member having a first surface and an opposed second surface. The first surface of the insulating member is joined to the second surface of the heat dissipating strip. The second surface of the insulating member is joined to the first surface of the resistive member.

The razor comprises an electrical circuit configured to deliver energy to the resistive member to heat the resistive member of the heating element. The resistive member of the heating element delivers heat to the heat dissipating strip.

At least part of the electrical circuit may be disposed within the cartridge.

The resistive member is preferably configured to heat the heat dissipating strip to a surface temperature between about 30° and 70° C. Preferably, the heat dissipating strip comprises a metal strip. The metal strip may be selected from the group consisting of aluminum, copper, gold, steel, brass, nickel and alloys thereof.

Preferably, the contacting surface of the heat dissipating strip is positioned substantially adjacent to the skin contacting surface of the cartridge.

A power source is in electrical communication with the electrical circuit. The power source preferably comprises a battery. Preferably, the battery is disposed within the handle. The battery may be disposable or rechargeable.

The razor may be configured to be mounted in electrical communication with a recharging station.

The razor may comprise a second insulating member. The second insulating member has a first surface and an opposed second surface. The first surface of the second insulating member is joined to the second surface of the resistive member.

The resistive member has a first end and an opposed second end and an electrical contact is provided at each of the first end and the second end. Preferably, the electrical contact is selected from the group consisting of silver, aluminum, copper, gold, steel, brass, nickel and alloys thereof.

The razor may comprise an indicator visible to a user of the razor constructed to provide a visual indication showing whether the electrical power is on or off.

The razor may comprise an indicator visible to a user of the razor constructed to provide a visual indication showing whether the heat dissipating strip is warm or thermally charged.

The cartridge may be separable from the handle. The cartridge may be pivotally mounted on the handle.

The razor may comprise a control circuit for temperature regulation. The razor may comprise a sensor, e.g., temperature, pressure, force, capacitive, optical, in communication with the control circuit.

The term "razor", as used herein, unless otherwise indicated refers both to razors that include a handle and a replaceable cartridge, and to disposable razors in which the razor cartridge is fixedly mounted on a handle.

The details of one or more embodiments of the invention are set forth in the accompanying drawings and the description below. Other features and advantages of the invention will be apparent from the description and drawings, and from the claims.

DESCRIPTION OF DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION

Figure 1:
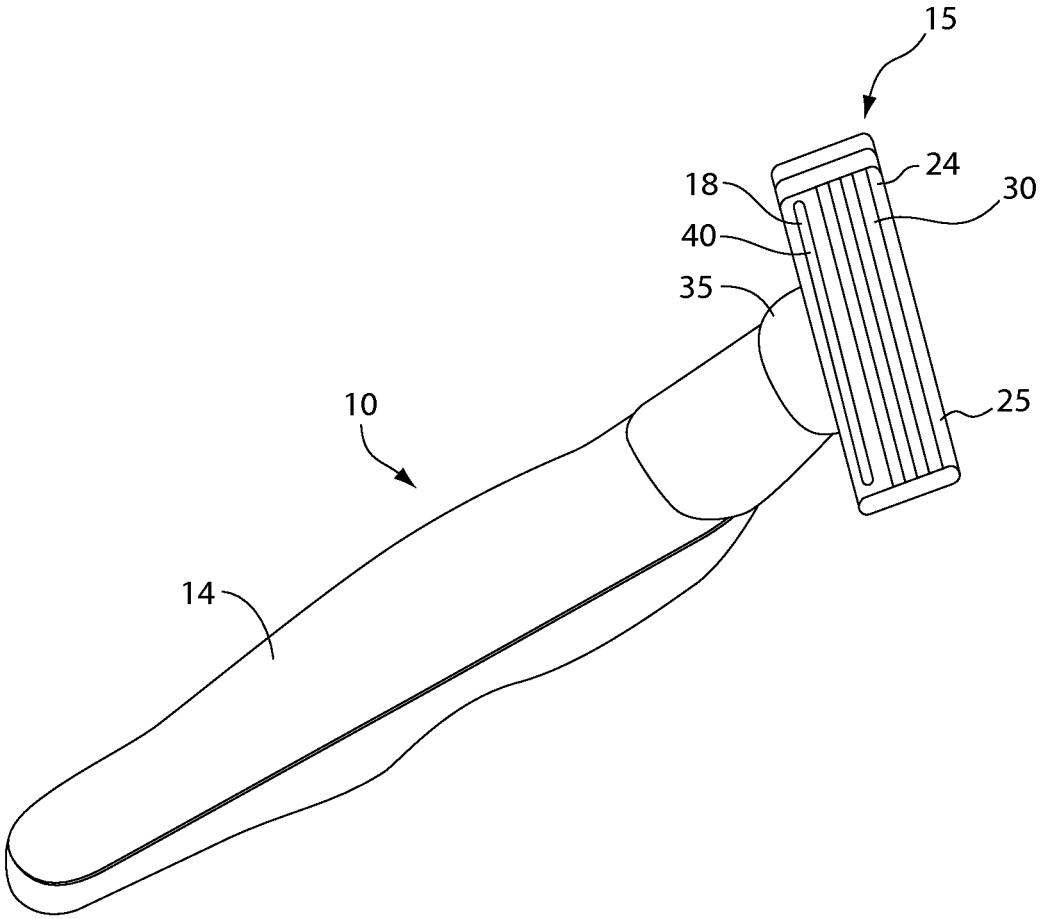
FIG. 1 is a perspective view of a razor of the present invention.
Figure 2:
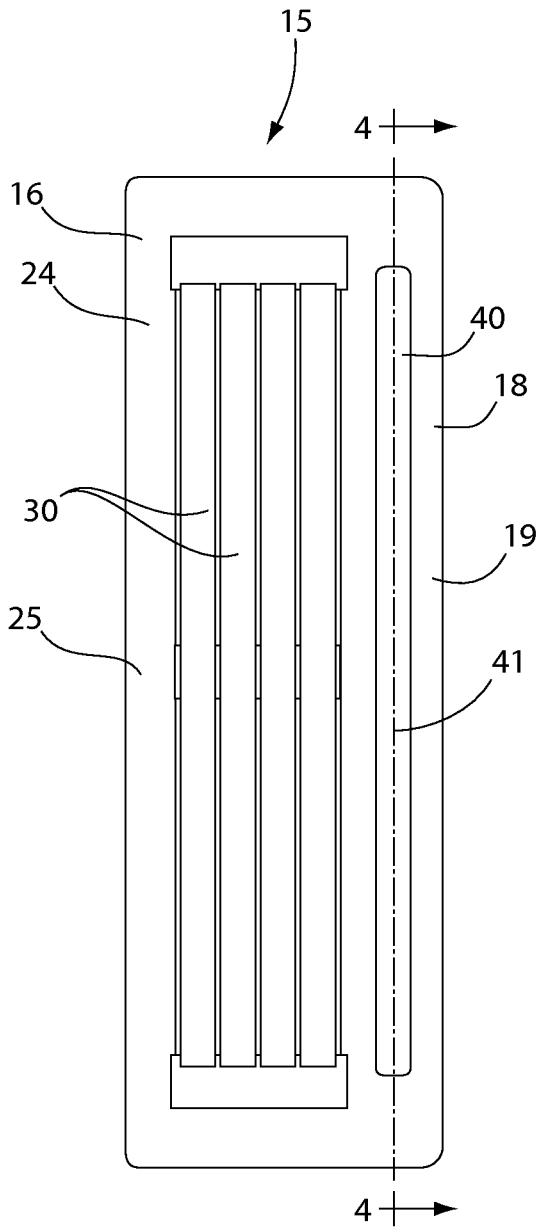
FIG. 2 is a top plan view of the razor cartridge of FIG. 1.
Figure 3:
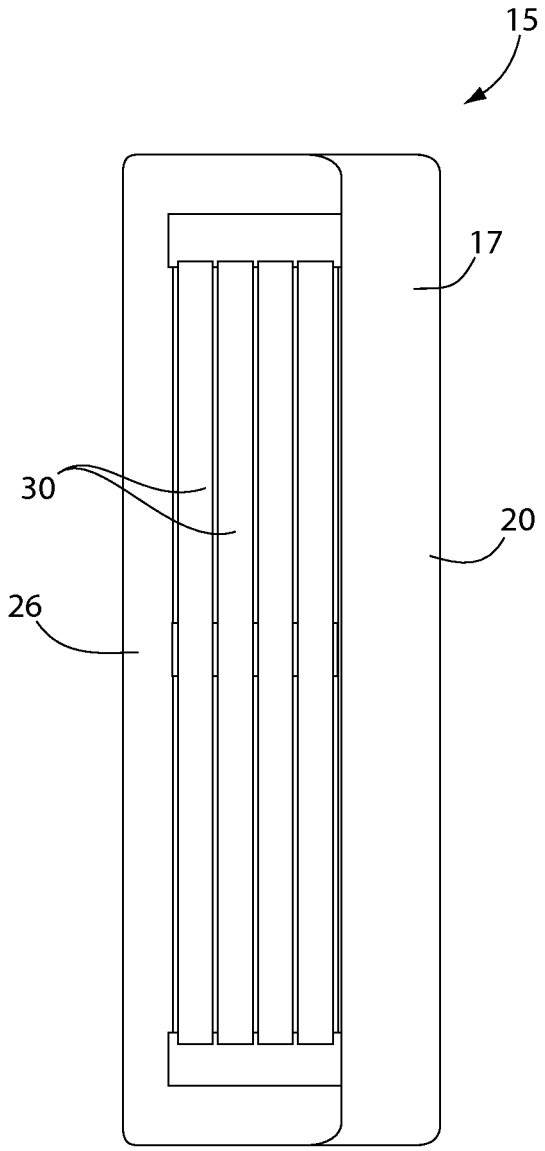
FIG. 3 is a bottom plan view of the razor cartridge of FIG. 1.
Figure 4:
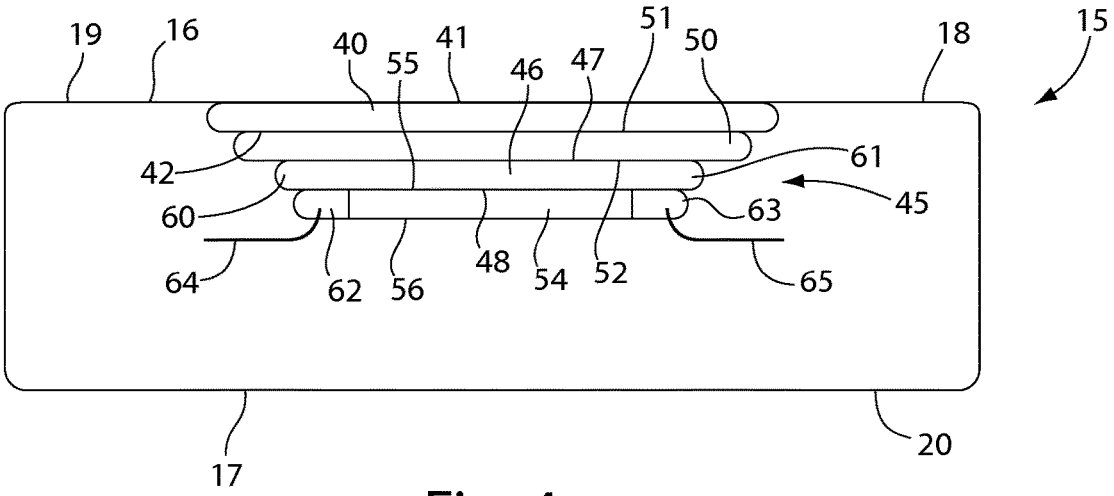
FIG. 4 is a cross-sectional view of the razor cartridge of FIG. 2 taken along second line 3-3.

Referring to FIGS. 1-5, razor 10 includes a handle 14 and a razor cartridge 15 mounted on the handle 14. Razor cartridge 15 comprises a guard 18, a cap 24 and one or more blades 30 positioned between the guard 18 and the cap 24. The cartridge 15 comprises an upper or skin contacting surface 16 and an opposed lower or bottom surface 17. The guard 18 is positioned in front of the one or more blades 30. The cap 24 is positioned behind the one or more blades 30. The guard 18 has an upper or skin contacting surface 19 and an opposed lower or bottom surface 20. The cap 24 has an upper or skin contacting surface 25 and an opposed lower or bottom surface 26. The upper or skin contacting surfaces of the guard and cap 19 and 25, respectively, and the opposed lower or bottom surfaces of the guard and cap 20 and 26, respectively, form a portion of the upper or skin contacting surface 16 and the lower or bottom surface 17 of the cartridge 15.

Guard 18 may include a plurality of fins to engage and stretch the user's skin. Other skin engaging protrusions, e.g., as described in U.S. Pat. No. 5,191,712, which is hereby incorporated by reference, can be used. Guard 18 may be formed of elastomeric material, or may be formed of the same material as the rest of cartridge 15. Preferably, the fins are progressively taller toward the blades 30, so as to lift the hair gradually for a closer, more comfortable shave.

The razor cartridge 15 may also include other components that improve the performance or extend the life of the cartridge. A shaving aid composite may be provided at the upper edge of the cartridge 15 to deliver a lubricious substance to the user's skin, e.g., as described in U.S. Pat. Nos. 5,113,585 and 5,454,164, the disclosures of which are hereby incorporated by reference.

Cartridge 15 is removably mounted on handle 14 by an interconnect member 35. The cartridge 15 may be pivotally or rigidly (non-pivotally) mounted with respect to the handle 14.

A heat dissipating strip 40 is positioned within the guard 18. The heat dissipating strip 40 comprises an upper or skin contacting surface 41 and a lower or second surface 42 opposed to the skin contacting surface 41. The skin contacting surface 41 of the heat dissipating strip 40 is shown positioned substantially adjacent to the skin contacting surface 16 of the cartridge 15 and the skin contacting surface 19 of the guard 18. That is the skin contacting surface 41 of the heat dissipating strip 40, the skin contacting surface 16 of the cartridge 15 and the skin contacting surface 19 of the guard 18 may all be contacted by the user's skin during shaving. The skin contacting surface 41 of the heat dissipating strip may be positioned above or below the skin contacting surface 16 of the cartridge 15 and the skin contacting surface 19 of the guard 18.

A heating element 45 is positioned below the second surface 42 of the heat dissipating strip 40 and above the bottom surface 17 of the cartridge 15 and the bottom surface 20 of the guard 18. The heating element 45 comprises a resistive member 46 and an insulating member 50. The resistive member 46 has a first surface 47 and an opposed second surface 48. The insulating member 50 has a first surface 51 and an opposed second surface 52. The first surface 51 of the insulating member 50 is joined to the second surface 42 of the heat dissipating strip 40. The second surface 52 of the insulating member 50 is joined to the first surface 47 of the resistive member 46.

The heating element 45 comprises a second insulating member 54. The second insulating member 54 has a first surface 55 and an opposed second surface 56. The first surface 55 of the second insulating member 54 is joined to the second surface 48 of the resistive member 46. The second insulating member 54 is preferably positioned above the bottom surface 17 of the cartridge and the bottom surface 20 of the guard 18.

The resistive member 46 has a first end 60 and an opposed second end 61. Electrical contacts 62 and 63 are provided at each end 60 and 61, respectively, of resistive member 46. The electrical contacts 62 and 63 may comprise silver. Other conductive materials such as aluminum, copper, gold, steel, brass, nickel, and alloys thereof may be used for electrical contacts 62 and 63. Current leads 64 and 65 are secured to electrical contacts 62 and 63, respectively, to form part of an electrical circuit which is configured to deliver energy to the resistive member 46 to heat the resistive member 46. The current leads 64 and 65 are positioned within the cartridge. 15. The resistive member 46 of heating element 45 delivers heat to the heat dissipating strip 40 which is dissipated over the upper or skin contacting surface 41 of the heat dissipating strip 40 to provide warmth to the user's skin during shaving.

Figure 5:
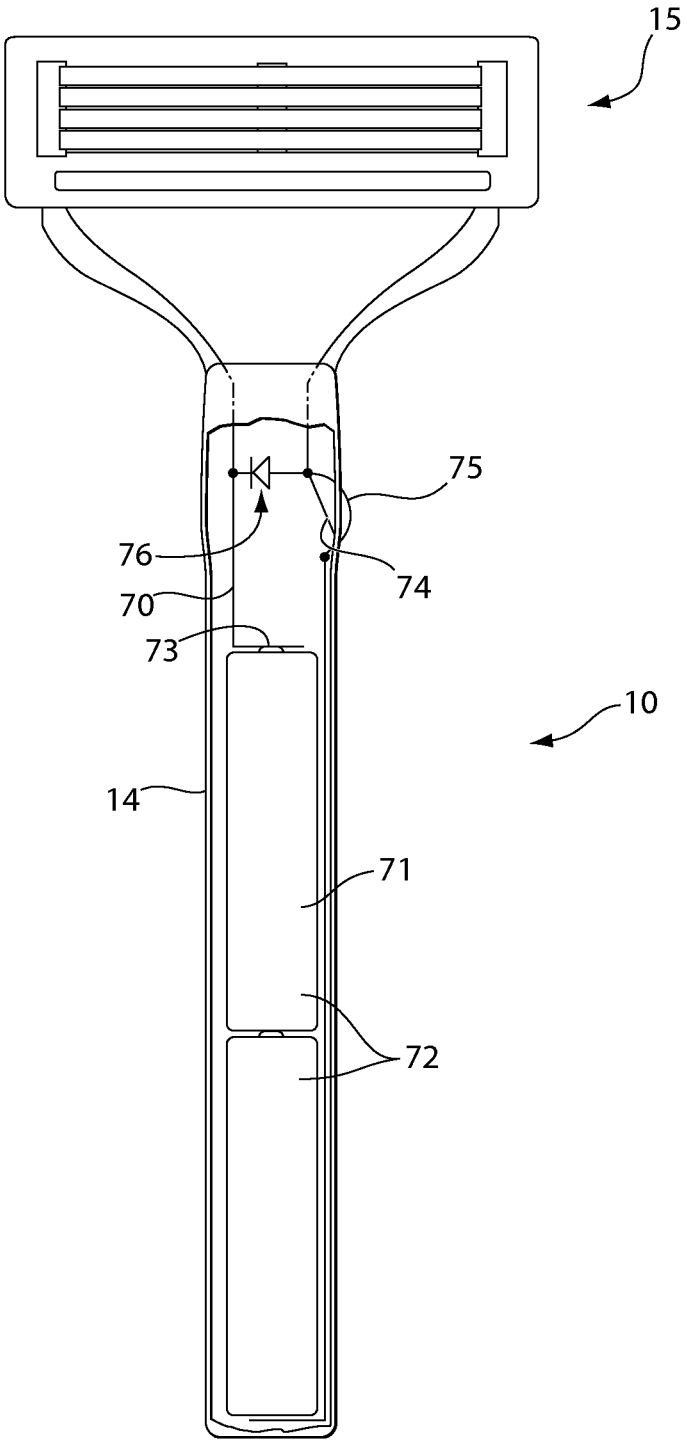
FIG. 5 is a diagrammatic front view of a razor of FIG. 1.

Referring to FIG. 5, razor 10 includes an electrical circuit 70 to which current is supplied by a power source 71 such as one or more batteries 72, through a contact 73. Batteries 72 are positioned within handle 14. Batteries 72 may be either disposable or rechargeable. The electrical circuit 70 is closed by a switch 74, which may be actuated by the user by pushing button 75. While the switch/button are on the side of the razor handle 14 in the embodiment shown, they may be positioned elsewhere, e.g., at the bottom of the handle. An LED 76 is provided in handle 14 to indicate to the user that the power has been turned on or off. The LED may be disposed in a transparent area of the cartridge 15, or may extend through an opening in an opaque area of the cartridge 15. The LED may be positioned in an area of the razor other than that shown in FIG. 5, or may be omitted. The LED may indicate whether the heat dissipating strip is warm or warming, whether the heat dissipating strip is too hot and other properties of the razor.

The heat dissipating strip 40 may be comprised of any material that is effective in dissipating heat. A suitable material for the heat dissipating strip is a metal such as aluminum, copper, gold, steel, brass, nickel and alloys thereof with aluminum being the preferred metal. Other materials having heat dissipating properties similar to those of the metals listed may also be used.

The heat dissipating strip 40 may be coated or textured to provide an improved user experience as it may come into direct contact with the user's skin during shaving. For example, the heat dissipating strip 40 may be textured with small protuberances or bumps and coated with a polymer composition such as a polyfluorocarbon.

The insulating member 50 may be comprised of glass, glass-ceramic, ceramic, oxides, or any other dielectric materials.

The resistive member 46 may be comprised of a sol-gel solution filled with a conductive powder. A coating may be formed by mixing a sol-gel solution with up to about 90% by weight of the solution of a conductive powder to provide a uniform stable dispersion. Suitable resistive members are disclosed in WO 02/072495 A2.

The resistive member may also be constructed of nickel chromium, gold, steel and other materials.

The resistive member preferably has a resistance of from about 0.1 to about 100 Ohm, more preferably from about 0.5 to about 20 Ohm, and most preferably 2 Ohm.

The second insulating member 54 may be comprised of glass, glass-ceramic, ceramic, oxides or any other dielectric materials.

The resistive member may be joined to the insulating members by a sol-gel process, spraying, dipping, spinning, brushing, printing, sputtering, gluing or other suitable techniques.

Preferably the resistive member 46 heats up sufficiently to heat the heat dissipating strip 40 to a surface temperature of from about 30° C. to about 70° C.

In the embodiment shown in FIG. 1, the cartridge 15 is rigidly (non-pivotally) mounted on the handle 14.

Figure 6:
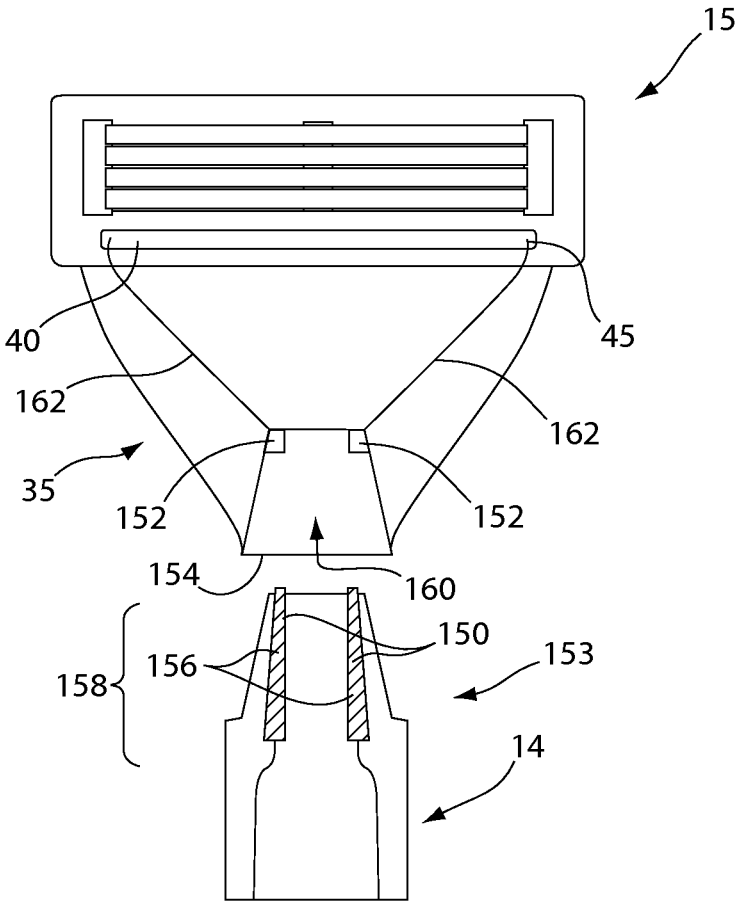
FIG. 6 is an exploded front plan view of an alternative cartridge and the upper portion of a handle of the present invention.

Referring now to FIG. 6, current is transferred between the handle 14 and the cartridge 15 by engagement of mating contacts 150 on the handle 14 and 152 on the cartridge 15. These contacts may be at the distal end 153 of the handle 14 and the intersection of interconnect member 35 and cartridge 15, as shown in FIG. 6, or closer to the rim 154 of the interconnect member 35. The contacts 150 are spring-loaded, i.e., biased toward the cartridge 15 by springs 156. The distal end 153 of the handle 14 may include a generally frustro-conically shaped portion 158 and the cartridge 15 may include a corresponding frustro-conical bore 160, to allow sliding engagement of the handle with the cartridge.

In the embodiment shown in FIG. 6, the cartridge 15 is pivotally mounted on the handle 14. While pivoting, the electrical communication between the cartridge 15 and the handle 14 is maintained. Leads 162 extend from contacts 152 to connect with heating element 45 positioned below heat dissipating strip 40. Suitable methods for maintaining a pivotal electrical connection are disclosed in US 2006/0074242 which is hereby incorporated by reference.

Figure 7:
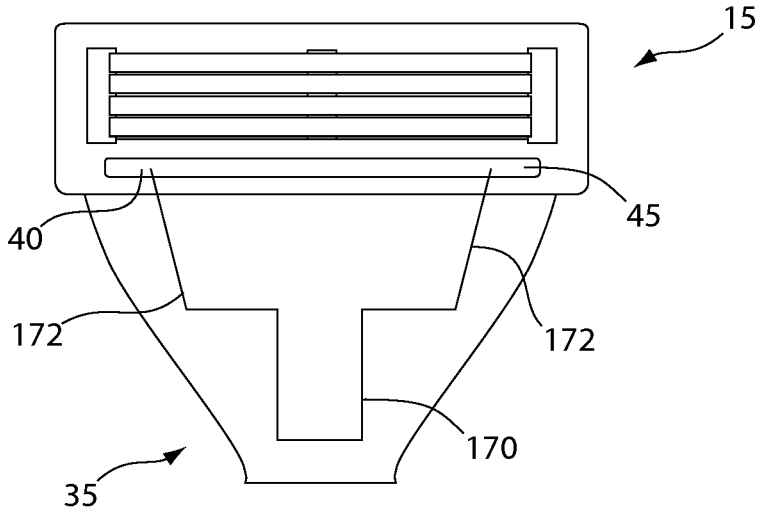
FIG. 7 is a front plan view of an alternative cartridge of the present invention.

Alternatively as shown in FIG. 7, a flexible circuit board 170 having leads 172 may provide the electrical connection for cartridge 15 to be pivotally mounted on a handle. The flexible circuit board 170 extends from interconnect member 35 into cartridge 15 to connect with heating element 45 positioned below heat dissipating strip 40.

In another alternative embodiment, the cartridge is integrally joined to the handle, rather than providing a separate interconnect member. For example, the cartridge may be directly joined to the handle allowing the circuit to extend continuously from the handle to the cartridge.

The circuit may be provided in any desired manner, for example by the use of wires insert molded into the plastic of the cartridge and handle, or by a conductive path defined by an electrically conductive polymer co-molded with the plastic of the cartridge and handle. Suitable electrically conductive polymers include carbon and graphite filled polymers.

Alternatively, the circuit may be provided by printing an electrical track onto a polymeric member. The printed electrical track may then be covered with additional material by printing, molding or other techniques.

It may be desirable to include an indicator that will provide a visual indication to the user of whether the razor is warming or heating up, whether the razor is warm or heated and ready for use, whether the power source is charging, whether the power source is charged, and whether the razor is too hot for safe usage. The indicator may be an LED, such as LED 76 shown in FIG. 5, a thermocromic material or other type of indicator.

The indicator may flash red when the razor is warming up. The indicator may be a continuous red when the razor is warm. The indicator may be a flashing green when the power source is charging. The indicator may be a continuous green when the power source is charged. The indicator may be white when the razor is too hot for safe usage.

As mentioned, the indicator may include a thermochromic material that changes color in response to a temperature change. The indicator may include two or more different thermochromic materials that change color at different temperatures. For example, the indicator may include a first thermochromic material that turns blue when the heat dissipating strip is at ambient temperature, a second thermochromic material that turns green when the heat dissipating strip is within the desired temperature range, and a third thermochromic material that turns orange when the heat dissipating strip is above the desired temperature range. Many other combinations of thermochromic materials may be used. Thermochromic materials can also be combined with non-thermochromic dyes and/or pigments to obtain desired colors.

Figure 8:
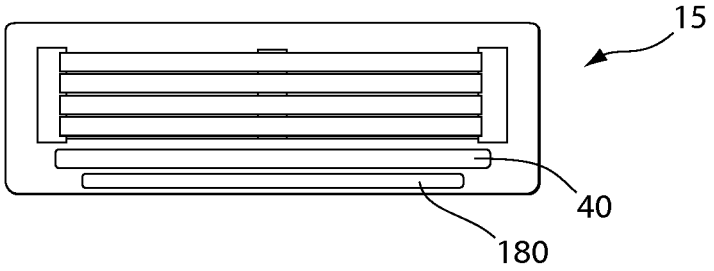
FIG. 8 is a front plan view of an alternative cartridge of the present invention.

The indicator may be in the form of a strip 180 that is mounted on or molded into the razor cartridge 15 adjacent the heat dissipating strip 40, as shown in FIG. 8. In this case, different thermochromic materials may be positioned at intervals along the strip. The indicator may instead be in the form of discrete pads or areas of any desired shape. Alternatively, the indicator may be in the form of letters or other indicia that appear and disappear, e.g., "HOT" and "COLD". Indicia may be provided, for example, by forming indicia that include thermochromic materials, or by providing non-thermochromic indicia that are obscured by a thermochromic coating that becomes translucent at a predetermined temperature.

In other implementations, the thermochromic material may be compounded with the plastic of the razor cartridge. The thermochromic material may also be coated on the cartridge.

Although a thermochromic indicator is desirable from the standpoints of readability and simplicity, other indicators may be employed such as a liquid filled thermometer of various shapes or a compound bar type dial thermometer.

Figure 9:
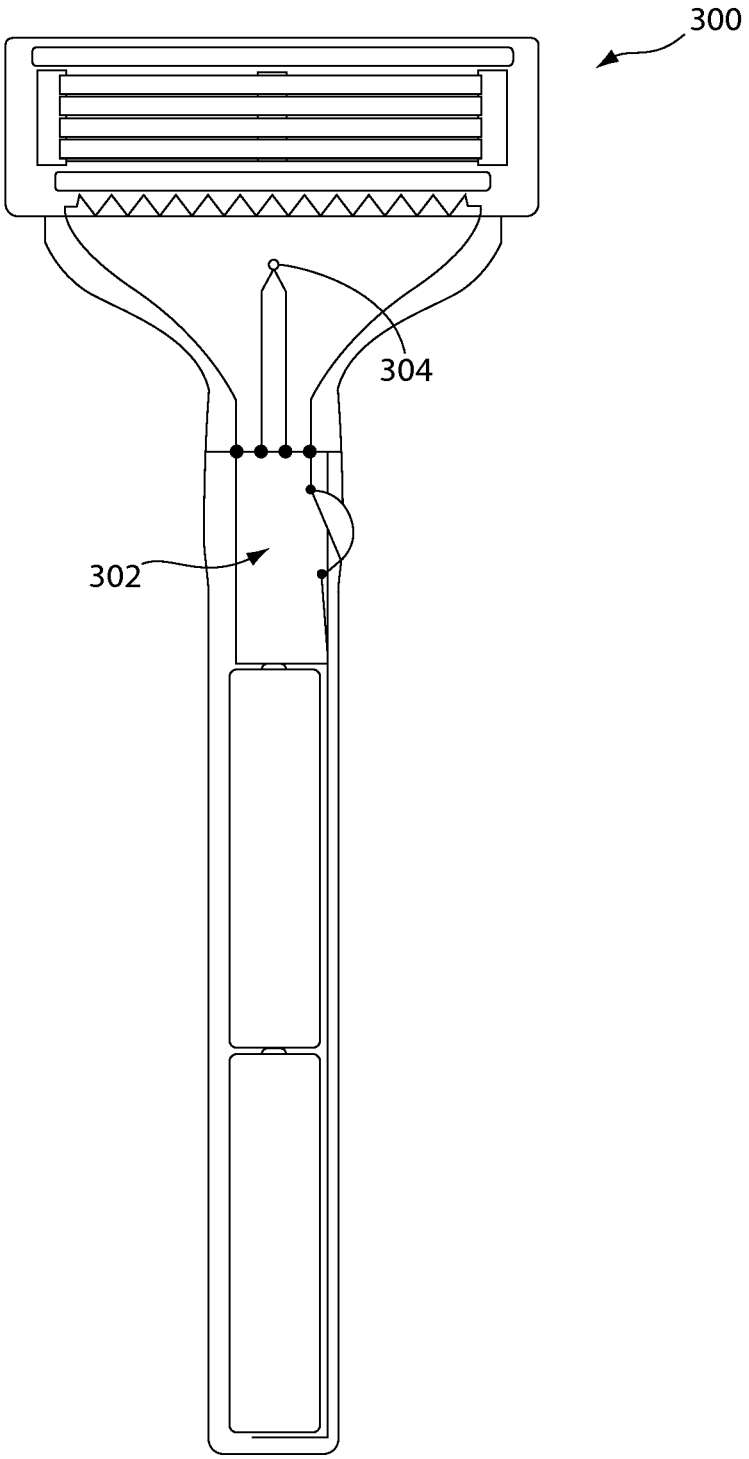
FIG. 9 is a diagrammatic view of a razor according to another embodiment, including a control circuit.

Moreover, in some embodiments, it may be desirable to include in the razor a control circuit for temperature regulation. An example of such a razor 300 is shown in FIG. 9. The control circuit 302 is configured to control the temperature by means of a temperature sensor 304. The temperature sensor 304 may be located directly on the heat dissipating strip. Alternatively, the temperature sensor 304 may be positioned adjacent to the heat dissipating strip.

A dial or other control mechanism (not shown) may be provided to allow the user to manually adjust the temperature. The circuit may also include a pressure sensor (not shown). In this case, when the razor is placed against the skin, the circuit, in response to a signal from the pressure sensor, supplies more power to the razor to overcome the heat sinking effects of soap, water and skin contact. Conversely, the circuit reduces power output when pressure is not detected, i.e., when the razor is not in contact with the skin, to prevent a thermal runaway. Thus, the razor is held at a reduced temperature when the power is on but the user is not shaving, so that when the user commences shaving again the razor temperature is not uncomfortably or dangerously hot.

Alternatively a capacitive sensor may be used. In this case, when the razor is placed against the skin, the circuit, in response to a signal from the capacitive sensor, supplies more power to the razor to overcome the heat sinking effects of soap, water and skin contact. Conversely, the circuit reduces power output when capacitance is not detected, i.e., when the razor is not in contact with the skin, to prevent a thermal runaway. Thus, the razor is held at a reduced temperature when the power is on but the user is not shaving, so that when the user commences shaving again the razor temperature is not uncomfortably or dangerously hot.

Other types of sensors may also be used. Examples of other types of sensors include but are not limited to pressure, force, and optical all in conjunction with the control circuit.

Figure 10:
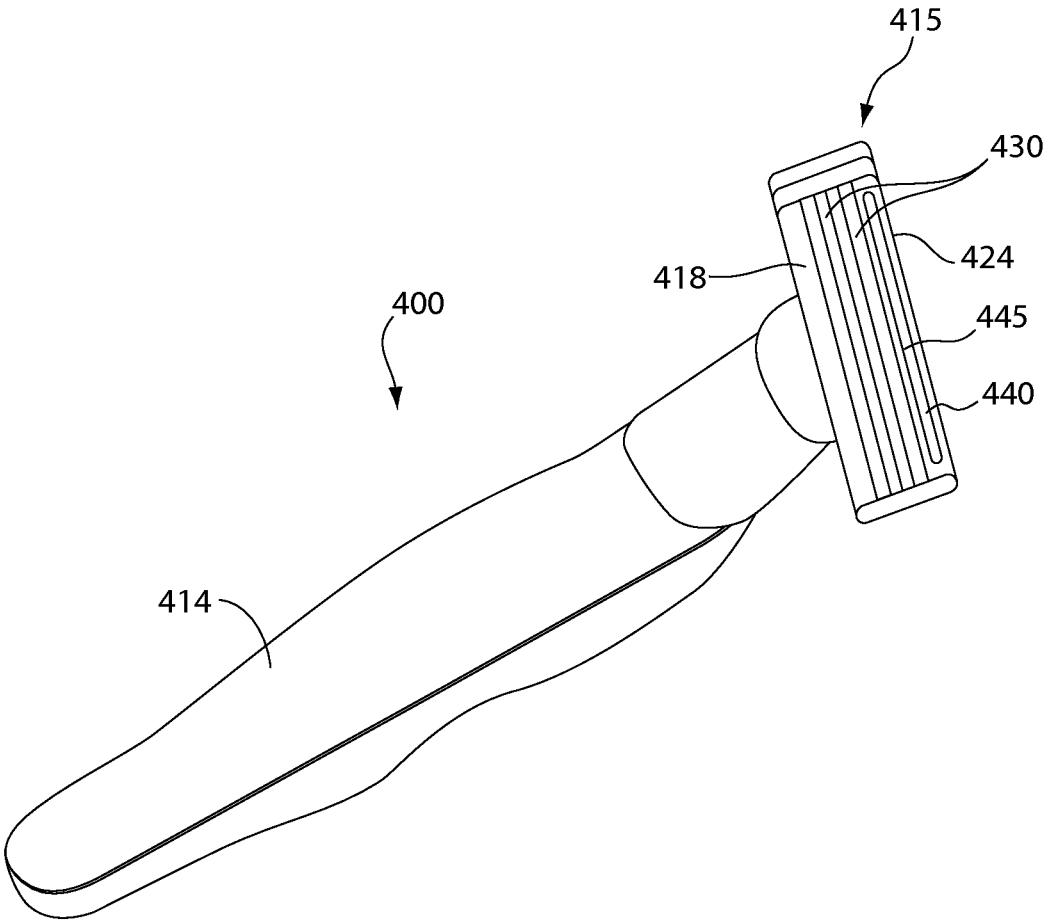
FIG. 10 is a perspective view of an alternative razor of the present invention.

Referring to FIG. 10, razor 400 includes a handle 414 and a razor cartridge 415 mounted on the handle 414. Razor cartridge 415 comprises a guard 418, a cap 424 and one or more blades 430 positioned between the guard 418 and the cap 424. Razor 400 is similar to razor 10 shown in FIG. 1 with the difference being the positioning of the heat dissipating strip 440. Heat dissipating strip 440 is positioned within cap 424. A heating element 445 identical to that described earlier is positioned below heat dissipating strip 440.

Cartridge 415 may be removably or fixedly mounted on handle 414. The cartridge 415 may be pivotally or rigidly (non-pivotally) mounted with respect to the handle 414.

Alternatively, a razor cartridge may include a heat dissipating strip and an accompanying heating element in both the cap and guard.

Figure 11:
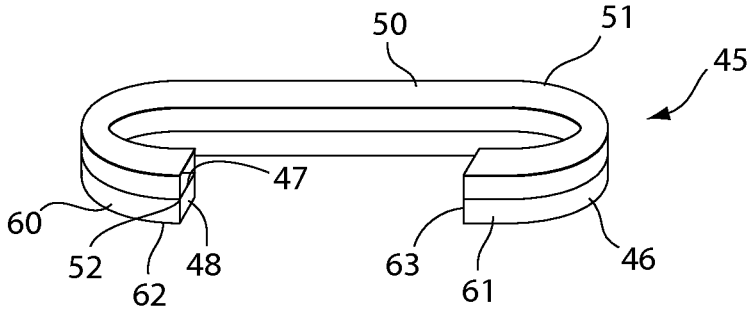
FIG. 11 is a perspective view of an alternative heating element of the present invention.

Referring to FIG. 11, there is shown an alternative heating element 45. The heating element 45 comprises a resistive member 46 and an insulating member 50. The resistive member 46 has a first surface 47 and an opposed second surface 48. The insulating member 50 has a first surface 51 and an opposed second surface 52. The second surface 52 of the insulating member 50 is joined to the first surface 47 of the resistive member 46.

The resistive member 46 has a first end 60 and an opposed second end 61. Electrical contacts 62 and 63 are provided at each end 60 and 61, respectively, of resistive member 46. The resistive member has an open loop-like configuration with the ends 60 and 61 opposed and adjacent one another. Other configuration for the resistive member may also be used.

In those instances where the heat dissipating strip is configured from an electrically conductive material an insulating member is needed to separate the resistive member which is electrically charged from the heat dissipating strip. Even though the heating dissipating strip may be configured from an electrically conductive material no electricity is to flow through the heat dissipating strip. If the heat dissipating strip is formed from a material which is non-electrically conductive no insulating member is needed to separate the resistive member from the heat dissipating strip.

Additionally, while certain razor designs have been shown and described above by way of example, the features described herein may be used in any desired razor design. For example, the features described above may be used in both men's and women's razors.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor comprising: a handle having a power source;

a cartridge mounted to the handle, the cartridge having a skin contacting surface, a metallic heat dissipating strip having an upper skin contact surface adjacent to the skin contacting surface of the cartridge; said metallic heat dissipating strip having no cutting edge;

a heating element positioned below the heat dissipating strip, the heating element comprising:

a resistive member with a pair of electrical contacts; wherein the resistive member has a resistance of about 0.5 Ohms to about 20 Ohms; and an insulating member comprising a ceramic positioned between the metal heat dissipating strip and the resistive member; and an electrical circuit in electrical communication with the power source and configured to deliver energy to the resistive member to heat the resistive member of the heating element and the resistive member of the heating element delivers heat to the heat dissipating strip.

2. The razor of claim 1 wherein the insulating member is directly joined to the metallic heat dissipating strip.

3. The razor of claim 2 wherein the resistive member is directly joined to the insulating member.

4. The razor of claim 3 wherein the resistive member is joined to the insulating member by printing.

5. The razor of claim 1 wherein the heat dissipating strip comprises steel.

6. The razor of claim 1 wherein the resistive member has a first end and an opposed second end, an electrical contact is provided at each of said first end and said second end.

7. The razor of claim 1 wherein the electrical contact is selected from the group consisting of silver, aluminum, copper, gold, steel, brass, nickel and alloys thereof.

8. The razor of claim 1 further comprising an indicator visible to a user of the razor constructed to provide a visual indication showing whether the power is on or off.

9. The razor of claim 1 further comprising an indicator visible to a user of the razor constructed to provide a visual indication showing whether the heat dissipating strip is warm.

10. The razor of claim 1 wherein the cartridge is separable from the handle.

11. The razor of claim 1 wherein the heat dissipating strip is positioned within said guard.

12. The razor of claim 1 wherein the heat dissipating strip is positioned within said cap.

13. The razor of claim 1, further comprising a control circuit for temperature regulation.

14. The razor of claim 13, further comprising a sensor in communication with the control circuit.

15. The razor of claim 14 further comprising a temperature sensor located directly on the heat dissipating strip.

16. The razor of claim 1 further comprising a flexible circuit board connected to the heating element.

17. The razor of claim 1 wherein the resistive member is configured to heat the heat dissipating strip to a surface temperature between about 30° and about 70° C.

18. The razor of claim 1 wherein further comprising a control circuit for temperature regulation, a sensor in communication with the control circuit, and a temperature sensor located directly on the heat dissipating strip in communication with the control circuit.

* * * * *